US011718952B2

(12) United States Patent
Lim et al.

(10) Patent No.: US 11,718,952 B2
(45) Date of Patent: Aug. 8, 2023

(54) METHOD OF CHEMICAL TREATMENT ON NONWOVENS

(71) Applicant: Tintoria Piana, US Inc., Cartersville, GA (US)

(72) Inventors: Sang-hoon Lim, Kennesaw, GA (US); Andrea Piana, Atlanta, GA (US)

(73) Assignee: Tintoria Piana, US Inc., Cartersville, GA (US)

( * ) Notice: Subject to any disclaimer, the term of this patent is extended or adjusted under 35 U.S.C. 154(b) by 451 days.

(21) Appl. No.: 16/880,002

(22) Filed: May 21, 2020

(65) Prior Publication Data

US 2020/0378057 A1 Dec. 3, 2020

Related U.S. Application Data

(60) Provisional application No. 62/965,240, filed on Jan. 24, 2020, provisional application No. 62/946,484,
(Continued)

(51) Int. Cl.
*D06M 10/04* (2006.01)
*D06M 23/16* (2006.01)
(Continued)

(52) U.S. Cl.
CPC ..... *D06M 10/04* (2013.01); *A47C 27/002* (2013.01); *D06B 5/08* (2013.01); *D06B 11/0059* (2013.01);
(Continued)

(58) Field of Classification Search
None
See application file for complete search history.

(56) References Cited

U.S. PATENT DOCUMENTS

2002/0193028 A1* 12/2002 Zuckerman ..... D06N 3/0061 442/182
2008/0120761 A1 5/2008 Yang et al.
(Continued)

FOREIGN PATENT DOCUMENTS

CN 201012560 Y * 1/2008
EP 594983 A1 * 5/1994 ..... B05B 3/02
(Continued)

OTHER PUBLICATIONS

English machine translation of Liang (CN 201012560 Y) accessed online from Espacenet; PDF pp. 1-11. (Year: 2010).*
(Continued)

*Primary Examiner* — Katie L. Hammer
(74) *Attorney, Agent, or Firm* — WC&F IP

(57) ABSTRACT

Nonwovens having low-density and resilience have a chemical formulation applied on one surface (e.g., a top surface) by any of various application methods. Then, the chemical formulation is forced to move toward the opposite surface of the nonwoven (e.g., move downward through the nonwoven from top to bottom). The chemical-treated nonwoven is dried to fix the chemical on the nonwovens. Movement through the nonwoven is performed in a controlled fashion so that after drying the distribution of a chemical formulation throughout the nonwoven (e.g., from the top surface to the bottom surface of a nonwoven) is controlled.

10 Claims, 2 Drawing Sheets

Related U.S. Application Data filed on Dec. 11, 2019, provisional application No. 62/946,173, filed on Dec. 10, 2019, provisional application No. 62/882,279, filed on Aug. 2, 2019, provisional application No. 62/854,547, filed on May 30, 2019.

(51) Int. Cl.

| | |
|---|---|
| ***D06M 23/12*** | (2006.01) |
| ***A47C 27/00*** | (2006.01) |
| ***D06M 23/02*** | (2006.01) |
| ***D06P 5/30*** | (2006.01) |
| ***D06B 5/08*** | (2006.01) |
| ***D06B 11/00*** | (2006.01) |
| ***D06B 19/00*** | (2006.01) |
| ***D06M 101/32*** | (2006.01) |

(52) U.S. Cl.

CPC ..... *D06B 19/0094* (2013.01); *D06M 23/02* (2013.01); *D06M 23/12* (2013.01); *D06M 23/16* (2013.01); *D06P 5/30* (2013.01); *D06M 2101/32* (2013.01)

(56) References Cited

U.S. PATENT DOCUMENTS

| | | | | |
|---|---|---|---|---|
| 2008/0121461 | A1 | 5/2008 | Gross et al. | |
| 2009/0162621 | A1* | 6/2009 | Craamer | D06M 16/00 427/75 |
| 2009/0288259 | A1* | 11/2009 | Lean | B29C 70/64 264/45.4 |
| 2017/0020299 | A1* | 1/2017 | Valenta | A47C 21/046 |
| 2018/0230647 | A1 | 8/2018 | Petton et al. | |

FOREIGN PATENT DOCUMENTS

| | | | | |
|---|---|---|---|---|
| EP | 678614 | A2 * | 10/1995 | D06B 1/06 |
| EP | 1350452 | A1 * | 10/2003 | A47G 9/0215 |

OTHER PUBLICATIONS

English machine translation of Wehrli (EP 1 350 452 A1) accessed online from Espacenet; PDF pp. 1-16. (Year: 2003).*

* cited by examiner

METHOD OF CHEMICAL TREATMENT ON NONWOVENS

CROSS-REFERENCE TO RELATED APPLICATIONS

This application claims priority to U.S. Provisional Application 62/854,547 filed May 30, 2019, U.S. Provisional Application 62/882,279 filed Aug. 2, 2019, U.S. Provisional Application 62/946,173 filed Dec. 10, 2019, U.S. Provisional Application 62/946,484 filed Dec. 11, 2019, and U.S. Provisional Application 62/965,240 filed Jan. 24, 2020, and the complete contents of each of these applications is herein incorporated by reference.

FIELD OF THE INVENTION

Aspects of the invention are generally related to a method to apply chemical formulations on nonwovens having resilience and low density. It provides a method to control the distribution of the chemical formulations applied on one surface of the nonwovens toward the opposite surface of the nonwovens.

BACKGROUND

Chemical treatment on woven or knitted fabrics is normally done by a pad-dry-cure method. In this method, the fabric is passed through a chemical bath for complete soaking. Then, an excess amount of chemical is removed from the woven or knitted fabric by passing it through a pair of squeezing rollers. Finally, the woven or knitted fabric is dried and cured to fix the chemicals on the fabric. This method might be used for high-density nonwovens, whose shapes are not much affected by the soaking and squeezing. However, the nonwovens with low density and bulkiness cannot be treated with chemicals by a pad-dry-cure method since the nonwovens will lose their shapes by the soaking and squeezing. Also, the physical strength of the nonwovens is generally not strong enough to sustain the process and they will be damaged after the process. Thus, there is a need for a method that applies chemical formulations on the nonwovens with minimal damage to them.

SUMMARY

In an embodiment of the invention, a chemical formulation is applied on one surface of a nonwoven having resilience and low density by various application methods, and the chemical formulation is forced to move through the body of the nonwoven toward the opposite surface of the nonwoven. The chemical-treated nonwoven is dried to fix the chemical on the nonwoven. The distribution of a chemical formulation from one surface to the opposite surface of a nonwoven may also be controlled in various embodiments of the invention.

DETAILED DESCRIPTION

Figure 1:
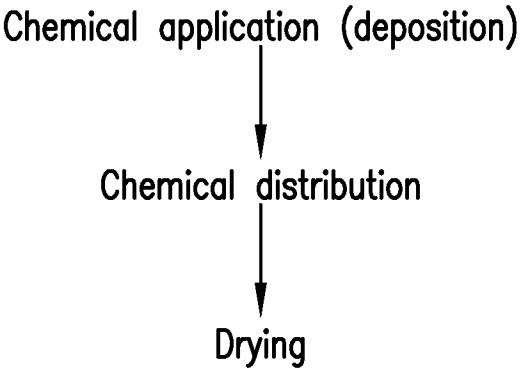
FIG. 1. is a general scheme of the inventive process.

Aspects of the invention are generally related to a chemical treatment method for use on nonwovens having low-density and resilience. In this application, the low-density nonwovens are defined as the nonwovens that have a density ranging from 0.15 g/cm$^3$ (gram/cubic centimeter) to 0.001 g/cm$^3$ (or below). Nonwovens with resilience are defined as nonwovens that have a thickness loss of not more than 80% after the entire chemical treatment process comprising chemical application, chemical distribution, and drying steps. Nonwovens of low-density and resilience are available from a number of commercial sources including Piana Nonwovens LLC (Cartersville, Ga.).

A nonwoven is a manufactured sheet, web, or batt of natural and/or man-made fibers or filaments that are bonded to each other by any of several means. Manufacturing of nonwoven products is well described in "Nonwoven Textile Fabrics" in Kirk-Othmer Encyclopedia of Chemical Technology, 3rd Ed., Vol. 16, July 1984, John Wiley & Sons, p. 72~124 and in "Nonwoven Textiles", November 1988, Carolina Academic Press. Web bonding methods include mechanical bonding (e.g., needle punching, stitch, and hydro-entanglement), chemical bonding using binder chemicals (e.g., saturation, spraying, screen printing, and foam), and thermal bonding using binder fibers with low-melting points. Two common thermal bonding methods are air heating and calendaring. In air heating, hot air fuses low-melt binder fibers within and on the surface of the web to make high-loft nonwoven. In the calendaring process, the web is passed and compressed between heated cylinders to produce a low-loft nonwoven.

The vertically lapped nonwoven material can be produced by commercially available machines, such as V-Lap vertical lapping systems sold by V-Lap Pty Ltd. and by Struto International, Inc. In the V-Lap system, staple fiber blend including binder fibers are opened, blended, and carded. The carded fiber web is pleated and the fibers are bonded mechanically (needling) and thermally to produce vertically lapped nonwovens. In the Struto system, the carded fiber web containing binder fiber is fed into the Struto lapping device. The vertical lapper then folds the web into a uniform structure. The folds are compressed together into a continuous structure, which is held in vertical position as it passes the heated thermal bonding oven. Due to its vertical fiber arrangement, the vertically lapped nonwovens provide better resilience and shape recovery to compression compared to cross lapped nonwovens.

Any type of nonwoven can be used for this application as long as it is within the specification of the resilience and density described in this application. (thickness loss not more than 80% after the entire chemical treatment process and a density of 0.15 g/cm$^3$ or below). The preferred nonwovens for this application are thermal-bonded vertically lapped nonwovens and thermal-bonded cross lapped nonwovens.

When nonwovens are made with elastomeric binder fibers and high resilience fibers, it provides a better resilience to the nonwovens. As examples of the elastomeric polyester binder fibers, these include but are not limited to ELK®, E-PLEX®, and EMF type high elastic LMF that are commercially available from Teijin Limited, Toray Chemical Korea Inc., and Huvis Corporation, respectively. The elastomeric polyester binder fiber provides an elastic property to the nonwoven and provides bonding between fibers after the thermal bonding process. To provide bulkiness and resilience to the nonwoven, hollow conjugate polyester fiber can be used together with binder fibers, such as the elastomeric binder polyester fiber, conventional binder fibers, or any combination of these. In addition to these fibers, other fibers can be used to give other required functions. Other fibers include but not limited to man-made (e.g., rayon, lyocell, Nylon, Kevlar, etc.) and/or natural fibers (e.g., cotton, jute, silk, wool, linen, cashmere, etc.). Exemplary types of polyesters include but are not limited to PET (polyethylene terephthalate), PTT (polytrimethylene terephthalate), and PBT (polybutylene terephthalate). The most commonly used polyester is PET.

Examples of fiber blends for the cross lapped and vertically lapped nonwovens having low-density and resilience that could be used in the practice of this invention include but are not limited to the following:

- Elastomeric polyester binder fiber (6 denier×64 mm): High shrink polyester fiber (1.4 denier×51 mm): Low-melt polyester binder fiber (4 denier×51 mm):Regular polyester fiber (6 denier×51 mm)=25:20:10:45
- Hollow conjugate polyester fiber (3 denier×51 mm): Elastomeric polyester binder fiber (6 denier×64 mm)=60:40
- Hollow conjugate polyester fiber (15 denier×51 mm): Elastomeric polyester binder fiber (6 denier×51 mm)=60:40
- Hollow conjugate polyester fiber (15 denier×51 mm): Low-melt polyester binder fiber (4 denier×51 mm)=70:30
- Hollow conjugate polyester fiber (3 denier×51 mm):High shrink polyester fiber (1.4 denier×51 mm):Elastomeric polyester binder fiber (6 denier×64 mm):Low-melt polyester binder fiber (4 denier×51 mm)=40:20:30:10
- Hollow conjugate polyester fiber (3 denier×51 mm):High shrink polyester fiber (1.4 denier×51 mm):Elastomeric polyester binder fiber (6 denier×64 mm)=50:10:40
- Hollow conjugate polyester fiber (3 denier×51 mm): Hollow conjugate polyester fiber (15 denier×51 mm): Elastomeric polyester binder fiber (6 denier×64 mm): Low-melt polyester binder fiber (4 denier×51 mm)=50:25:15:10

Figure 2:
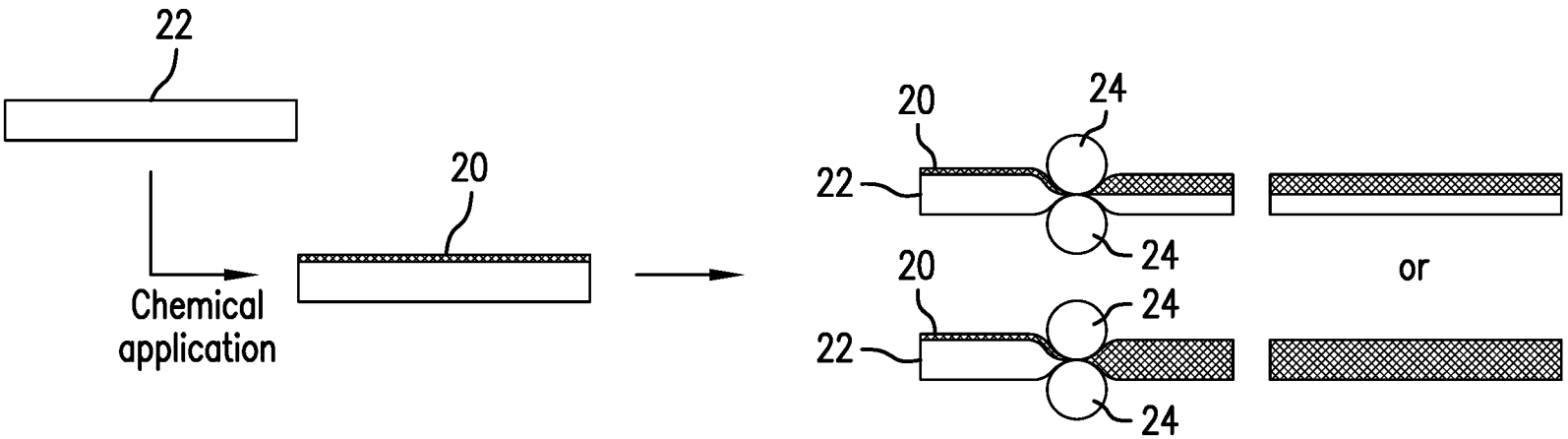
FIG. 2. is an order set of side views of nonwovens at each step of the process.

FIG. 1 shows the general scheme of the process, which comprises chemical application (deposition), chemical distribution, and drying. While FIG. 1 illustrates a three step process, other process steps may be performed before, after, and in between the three steps. The chief requirement is that the steps of deposition, distribution and drying are performed, and that the distribution step follows the deposition step, and that the drying step follows the distribution step. FIG. 2 illustrates side views of nonwovens (vertically lapped or not vertically lapped) at each step of the process.

The first step of the process is a chemical application step. A chemical formulation (for example, in a liquid form) is applied on one surface of the nonwoven having low-density and resilience. Generally speaking, it will be applied on the top surface in any desired pattern, and using any of a variety of application techniques including but not limited to inkjet technology, valve jet technology, spraying, foam application, digital printing, roller coating, doctor blade coating, and screen/rotary printing. Using these chemical deposition methods, the chemical formulation will reside mostly on the top surface of the nonwoven.

For the chemical formulations for the invention, any chemicals can be used. In some embodiments of this invention, chemicals used for this application provide functionality to the nonwovens. Exemplary chemicals include but not limited to water/oil repellents, antimicrobials, flame retardants, microencapsulated scents, microencapsulated cosmetics, microencapsulated essential oils, microencapsulated PCM (Phase Change Material), probiotics, odor control agents, photocatalytic agents, UV absorbers, anti-allergens, probiotics, hydrophilic agents, hand modifying agents, antistatic agents, insect repellents, and ceramics that emit far infrared and/or negative ions. The chemical formulations may include two or more different agents and/or two or more of the same class of agents (e.g., two different UV absorbers and one antistatic agent). The chemical formulations are preferred to be in liquid form such as aqueous or oil based solutions or dispersions in liquid form. In some applications, these chemicals can be combined to provide multi-functions on the treated nonwovens. In some applications, colors can be added to the formulation. An example chemical formulation that can be applied to a nonwoven comprises microencapsulated PCM, binder, wetting agent, and water.

Although any chemical application methods can be used for the invention, one of the preferred chemical application methods involves the use of a non-contact digital chemical deposition technology (e.g., digital printers, etc.). The technology allows deposition of chemical formulations on the nonwovens without physical contact between the chemical dispensing parts (e.g., nozzles or outlets) and nonwovens. Since it eliminates the physical stress that results from soaking and squeezing which are part of a pad-dry-cure process, the damage on the low-density nonwoven during chemical application is eliminated or minimized. An example of a non-contact digital chemical deposition technology that can be used for this invention includes but is not limited to CHROMOJET digital printing system from Zimmer based in Austria. A small laboratory sample can be prepared by a table-top digital printer as shown on FIG. 3.

Figure 3:
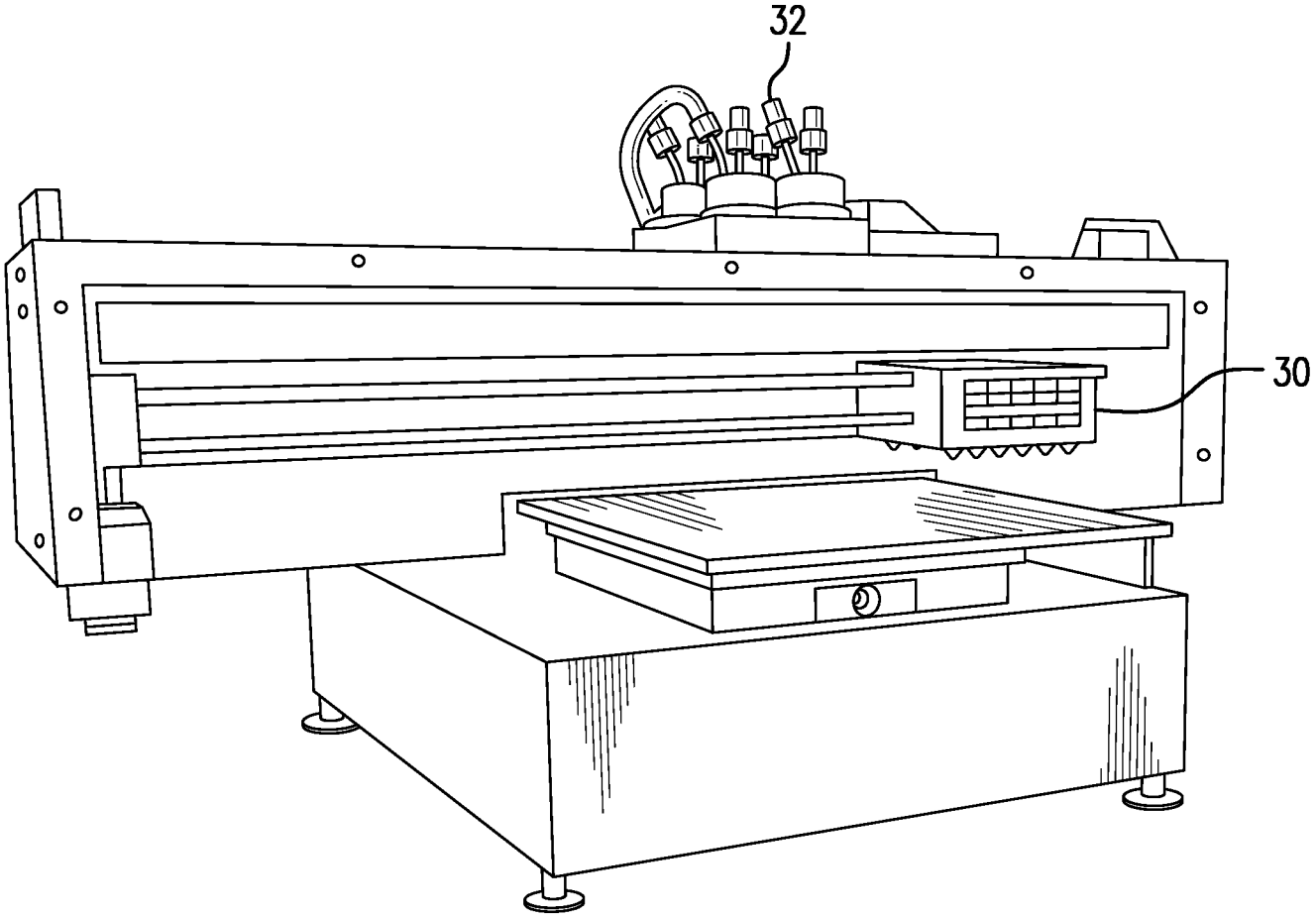
FIG. 3. is an illustration of a table-top digital printer which may be used in the practice of the invention.

In some applications, different chemicals can be combined to provide multi-functions on the nonwoven using a digital printing system. FIG. 3 shows by example, using multiple printing modules 30 with different chemicals in the modules (for example, a module A could contain antimicrobial finish and module B could contain microencapsulated PCM). In addition, different chemical formulation tanks 32 could be connected to different printing modules 30. This set up allows the different chemicals to be applied on a nonwoven at the same time. In some applications, colors can be added to the chemical formulation, or themselves be provided in a separate module for simultaneous application to the nonwoven. In applications where functionality is the primary concern, the digital printing system may be used to cover the majority of or the entire nonwoven with the functional chemical (i.e. the chemical is printed across the entire surface of nonwoven or a majority of the surface). However, in some applications it may be advantageous to print functional chemicals in a pattern which covers less than the entire nonwoven (e.g., in some applications, microencapsulate scents might be printed only in certain parts of the nonwoven, etc.). An example chemical formulation that can be digitally printed onto a low-density nonwoven with resilience comprises water repellent, binder, water, and printing auxiliaries, such as thickener and wetting agent.

One of the benefits of using a digital printing system for chemical application is to control the depth of chemical deposit on the nonwoven that is treated to a certain extent. The depth of chemical penetration and the amount of chemical applied on the nonwoven can be controlled by many variables, such as viscosity of the formula, the pressure applied to the formulation that is ejected through the nozzle, printing speed, printing resolution, pressing after printing, density of nonwovens, and so on.

The nonwoven for the treatment can be a single layer nonwoven or multilayer nonwovens. The multilayer nonwovens may be comprised of two or more layers of nonwovens, whose layers may be bonded together.

At some point after application of the chemical formulation to the nonwoven having low-density and resilience, chemical distribution is performed. The chemical distribution step is a physical step which causes the layer or deposited islands of the chemical formulation on a surface of a nonwoven to be physically distributed throughout the thickness of the nonwoven. In this step, the chemical formulation mainly resides on the surface to which it is applied (e.g., on the top surface) of the nonwoven although some portions of the chemical formulation may reside under the surface depending on the density of the nonwoven. During chemical distribution, the chemical formulation is forced to move through the nonwoven to the opposing surface (e.g. down toward the center or bottom of the nonwoven). The objective of chemical distribution is that after it is performed, the chemical formulation will no longer primarily reside on one surface (e.g., the top surface) of the nonwoven. The preferred chemical distribution method is pressing the nonwoven using at least one pair of press rollers. However, any type of pressing method can be utilized, and it can include but is not limited to using at least one pressing plate that presses down on the top surface of the nonwoven, or using at least one pressing top roller with a bottom moving conveyer carrying the nonwoven. In some embodiments, any non-pressing method can be used to distribute the chemical formulation from one surface of the nonwoven toward the opposite surface of the nonwoven, and this includes but is not limited to vacuum suction from the opposite surface of the nonwoven.

Not all compressive forces will be bad for nonwovens prepared according to this invention. For example, a cross lapped or vertically lapped nonwoven with resilience and good shape stability can be passed through a pair of press rollers after chemical application without noticeable structural deformation. By passing through the pair of press rollers, the chemicals applied on the nonwoven can be penetrated further down from the application surface of the nonwoven. The depth of the penetration is controlled by the gap and pressure between the rollers. The gap can be 0 mm or above depending on the depth of chemical penetration required. The main function of the press rollers is to make the applied chemical on the surface of the nonwoven move down through the nonwoven material, not to squeeze excess chemical from the nonwoven. By controlling the pressure or the gap, it would be, for example, to have the chemical move only from the surface on which it is applied to a middle portion of the nonwoven or to the opposite side of the nonwoven (e.g., 25% through, 50% through, 75% through, 100% through, etc.). For example, in some applications where the nonwoven is a multiple layered material, the chemical distribution step may be controllably performed to distribute the chemicals only in the top one or two layers and not have it distributed to the bottom one or two layers.

After distribution of chemical in the desired fashion, the nonwoven is dried primarily to fix chemicals on the nonwoven. But, in some embodiments, drying is also used to remove water/solvent from the chemical formulation. If needed, the nonwoven, after being dried, goes to a curing step.

FIG. 2 illustrates a variation on the methodology of FIG. 1 and is particularly suited to low-density nonwovens (vertically lapped or not vertically lapped) having resilience against some pressure applied by press rollers. In FIG. 2, the first step is to apply (deposit) a layer of a chemical formulation in liquid form in the same manner as shown in FIG. 1. Then, the nonwoven is passed through one or more pairs of press rollers. As shown in the last two panels of FIG. 2, the pressing action helps drive the chemical formulation down into the interior of the nonwoven, i.e., the chemical formulation will no longer primarily reside on the surface of the nonwoven. As illustrated in the second to last and last panel, more pressure can lead to a full penetration of the chemical formulation from the application side through the thickness to the opposing side of the nonwoven while less pressure application can lead to, for example, a half penetration. Depending on the final use of the product and its application, the chemical penetration depth can be controlled by controlling the amount of pressure and/or the gap of the pair of press rollers.

In one embodiment, a colorant is included in the chemical formulation and can be used as a gauge to demonstrate penetration of the chemical formulation into and/or through the thickness of the nonwoven. As discussed above, the chemical formulation may include water/oil repellents, antimicrobials, flame retardants, microencapsulated scents, microencapsulated cosmetics, microencapsulated essential oils, microencapsulated PCM (Phase Change Material), probiotics, odor control agents, photocatalytic agents, UV absorbers, anti-allergens, probiotics, hydrophilic agents, hand modifying agents, antistatic agents, insect repellents, and ceramics that emit far infrared and/or negative ions. Specifically, with referenced to FIG. 2, it can be seen that a layer of the chemical formulation with a colorant 20 (which can be continuous as shown, or which can be discontinuous) on the surface of the nonwoven 22 is subjected to physical distribution throughout the nonwoven by press rollers 24. Depending on such factors as the amount of pressure applied to the rollers 24, the weight of the rollers 24, the gap between the rollers 24, and the fibers in the nonwoven 22 and its construction, the chemical formulation can be distributed throughout the thickness of the nonwoven 22, or be only partially distributed. With colorant, the manufacturer may be able to more easily control how far chemicals in the chemical formulation are distributed into the nonwoven after a surface application using for example, an inkjet technology such as an inkjet printer. Of course, the process could be performed without a colorant depending on the needs of the manufacturer. The chemical-treated nonwoven goes to a drier to dry water/solvent from the formulation and/or to fix chemicals on the nonwoven.

The chemical-treated nonwovens in the invention can be used for a variety of applications such as, but not limited to consumer products, bedding, furniture, automotive, and airplane. For example, a nonwoven layer treated with microencapsulated PCM can be placed under a ticking fabric of mattresses to provide comfort to the user or used for mattress toppers.

As it will be apparent to those of skill in the art upon reading this disclosure, each of the individual embodiments described and illustrated herein has discrete components and features which may be readily separated from or combined with the features of any of the other several embodiments without departing from the scope or spirit of the present invention. Any recited method can be carried out in the order of events recited or in any other order which is logically possible.

The invention is further described by the following non-limiting examples which further illustrate the invention, and are not intended, nor should they be interpreted to, limit the scope of the invention.

EXAMPLE 1

A chemical formulation comprising microencapsulated scent (camomile), a binder, a thickener, a wetting agent, and water was applied on a cross lapped nonwoven made with 70% hollow conjuage polyester fiber (3 denier, 51 mm) and 30% Teijin ELK fiber (6 denier, 64 mm) using a table-top digital printing machine (table-top CHROMOJET by Zimmer Austria). The basis weight of the nonwoven was 225 gsm (grams/$m^2$). The amount of the chemical formulation applied on the nonwoven was 70 gsm. The nonwoven was dried in an oven at 120° C. until the formulation was completely dried. The dried chemical formulation resided mostly on the top surface of the nonwoven. The microencapsulated capsules release a scent when pressure or friction is applied on the nonwoven.

EXAMPLE 2

A chemical formulation comprising microencapsulated PCM, a binder, a thickener, a wetting agent, a blue reactive dye, and water was applied on a vertically lapped nonwoven made with 70% hollow conjuage polyester fiber (3 denier, 51 mm) and 30% Teijin ELK fiber (6 denier, 64 mm) using a table-top digital printing machine (table-top CHROMOJET by Zimmer Austria). The basis weight of the nonwoven was 600 gsm (grams/$m^2$). The amount of the chemical formulation applied on the nonwoven was 900 gsm. The chemical-applied nonwoven was passed through a pair of press rollers to force the chemical formulation on the surface of the nonwoven toward the bottom of the nonwoven. The gap between rollers was 0 mm and the pressure applied on the rollers was 0.4 MPa. Then, it was dried in an oven at 120° C. until the formulation was completely dried. Then it was cured 160° C. for 3 min. The dried chemical formulation was well distributed through the whole entire nonwoven as indicated by blue color. This final nonwoven has a cooling function due to the microencapsulated PCM and one of example use of this is for mattress.

While the present invention has been described in terms of preferred embodiments, those skilled in the art will recognize that the invention can be practiced with considerable modification within the spirit and scope of the appended claims.

It is noted that, as used herein and in the appended claims, the singular forms "a", "an", and "the" include plural referents unless the context clearly dictates otherwise. Having thus described the invention in rather full detail, it will be understood that such detail need not be strictly adhered to, but that additional changes and modifications may suggest themselves to one skilled in the art, all falling within the scope of the invention as defined by the subjoined claims.

The invention claimed is:

1. A chemical treatment method for a nonwoven, comprising:

applying a chemical formulation to one surface of a nonwoven comprised of a manufactured sheet, web, or batt of natural and/or man-made fibers or filaments that are bonded to each other having low-density ranging from 0.15 g/$cm^3$ to 0.001 g/$cm^3$; then distributing the chemical formulation through a thickness of the nonwoven by a physical process; and then drying the chemical formulation distributed within the nonwoven after the distributing step, wherein the nonwoven has a resilience of having a thickness loss of not more than 80% after performing the steps of applying, distributing and drying, wherein the chemical formulation includes phase change materials (PCMs).

2. The chemical treatment method of claim 1, wherein said applying step is performed using an application device selected from the group consisting of non-contact digital chemical deposition technology, valve jet technology, spraying, foam application, digital printing, roller coating, doctor blade coating, and screen/rotary printing.

3. The chemical treatment method of claim 1 wherein said chemical formulation further includes one or more of water/oil repellents, antimicrobials, flame retardants, microencapsulated scents, microencapsulated cosmetics, microencapsulated essential oils, probiotics, odor control agents, photocatalytic agents, UV absorbers, anti-allergens, probiotics, hydrophilic agents, hand modifying agents, antistatic agents, insect repellents, and ceramics that emit far infrared and/or negative ions.

4. The chemical treatment method of claim 3 wherein said chemical formulation further includes at least one colorant.

5. The chemical treatment method of claim 1 wherein said distributing step is performed using a pressing plate, a pair of press rollers, or vacuum suction.

6. A chemical treatment method, comprising:

applying using a non-contact digital chemical deposition technology a chemical formulation on a first surface of a nonwoven comprised of a manufactured sheet, web, or batt of natural and/or man-made fibers or filaments that are bonded to each other which has a low-density ranging from 0.15 g/$cm^3$ to 0.001 g/$cm^3$, wherein said nonwoven has second surface opposing said first surface and separated by a thickness; then physically distributing the chemical formulation from the first surface through the thickness toward the second surface by either applying a pressing force on the first surface or applying a suction force on the second surface; and then drying the chemical formulation on the nonwoven, wherein the chemical formulation includes phase change materials (PCMs).

7. The chemical treatment method of claim 6, wherein the nonwoven is resilient.

8. The chemical treatment method of claim 6, wherein the non-contact digital chemical deposition technology is a digital printer.

9. The chemical treatment method of claim 6, wherein the chemical formulation further includes one or more of water/oil repellents, antimicrobials, flame retardants, microencapsulated scents, microencapsulated cosmetics, microencapsulated essential oils, probiotics, odor control agents, photocatalytic agents, UV absorbers, anti-allergens, probiotics, hydrophilic agents, hand modifying agents, antistatic agents, insect repellents, and ceramics that emit far infrared and/or negative ions.

10. The chemical treatment method of claim 6, wherein said chemical formulation further includes at least one colorant, and one or more chemicals selected from the group consisting of water/oil repellents, antimicrobials, flame retardants, microencapsulated scents, microencapsulated cosmetics, microencapsulated essential oils, probiotics, odor control agents, photocatalytic agents, UV absorbers, anti-allergens, probiotics, hydrophilic agents, hand modifying agents, antistatic agents, insect repellents, and ceramics that emit far infrared and/or negative ions, wherein said at least one colorant is used as a marker to demonstrate physical distribution in the nonwoven of the one or more chemicals.

* * * * *